US007075387B2

(12) United States Patent
Pääkkönen et al.

(10) Patent No.: US 7,075,387 B2
(45) Date of Patent: Jul. 11, 2006

(54) DIRECTIONAL COUPLER, ANTENNA INTERFACE UNIT AND RADIO BASE STATION HAVING AN ANTENNA INTERFACE UNIT

(75) Inventors: Peter Pääkkönen, Kista (SE); Andrzej Plotka, Stockholm (SE); Jurek Dabrowski, Täby (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 187 days.

(21) Appl. No.: 10/433,391

(22) PCT Filed: Dec. 4, 2001

(86) PCT No.: PCT/SE01/02667

§ 371 (c)(1),
(2), (4) Date: Sep. 29, 2003

(87) PCT Pub. No.: WO02/47196

PCT Pub. Date: Jun. 13, 2002

(65) Prior Publication Data

US 2004/0041657 A1 Mar. 4, 2004

(30) Foreign Application Priority Data

Dec. 4, 2000 (SE) ..... 0004473
Dec. 5, 2000 (SE) ..... 0004468

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/116, 128, 238; 343/754
See application file for complete search history.

(56) References Cited

U.S. PATENT DOCUMENTS

| | | | | |
|---|---|---|---|---|
| 4,521,755 | A | 6/1985 | Carlson et al. | 333/244 |
| 4,612,548 | A * | 9/1986 | Beltran | 342/373 |
| 5,012,209 | A * | 4/1991 | Lantagne et al. | 333/116 |
| 6,542,048 | B1 * | 4/2003 | Sherman et al. | 333/128 |

FOREIGN PATENT DOCUMENTS

| | | |
|---|---|---|
| FR | 2 665 579 A1 | 2/1992 |
| JP | 62-114301 | 5/1987 |
| WO | WO 99/27606 | 6/1999 |
| WO | WO 99/33139 | 7/1999 |

* cited by examiner

*Primary Examiner*—Dean Takaoka
(74) *Attorney, Agent, or Firm*—Roger Burleigh

(57) ABSTRACT

A directional coupler for radio frequency application, comprising: an input (110) for receiving a radio frequency input signal; a port (120) for delivering a radio frequency output signal; a first elongated conductor (150; 150:1), suspended in air between two ground planes, for connecting the input (110) with the port (120); the first conductor (150) comprising a sandwich structure with a first upper conductive strip (150A), a first intermediate layer comprising a dielectric material and a first lower conductive strip (150B); a second elongated conductor (200; 200:1), suspended in air between two ground planes, the second elongated conductor (200:1) comprising a sandwich structure with a second upper conductive strip (200:1A), a second intermediate layer comprising a dielectric material and a second lower conductive strip (200:1B); said first elongated conductor (150; 150:1) and said second elongated conductor (200; 200:1) being substantially parallel; said first upper and lower conductive strips and said second upper and lower conductive strips, respectively, having conductive interconnections (190, 210, 158).

21 Claims, 5 Drawing Sheets

DIRECTIONAL COUPLER, ANTENNA INTERFACE UNIT AND RADIO BASE STATION HAVING AN ANTENNA INTERFACE UNIT

TECHNICAL FIELD OF THE INVENTION

The present invention relates to a directional coupler, an antenna interface unit, and to a radio base station having an antenna interface unit.

DESCRIPTION OF RELATED ART

A communications network for mobile radio units such as mobile phones, comprises radio base stations for establishing radio contact with mobile units within a certain range from the radio base station. The area covered by one radio base station, i.e. the range within which radio contact with sufficient quality is obtained, depends among other factors on the power of transmission from the radio base station. In order to ensure that a radio base station has an adequate level of output power, the power of the transmitted signal is often measured, within the radio base station at a point close to the antenna. Such measurement, however, should not contribute more than absolutely necessary to the losses in the system. Also, the reflected power from the antenna is preferably measured for the purpose of ensuring that the antenna is working properly.

SUMMARY

An aspect of the invention relates to the problem of providing a directional coupler for a radio base station, having high performance characteristics at a reduced cost.

This problem is solved, in accordance with an embodiment of the invention, by providing a directional coupler for radio frequency application, comprising:

an input for receiving a radio frequency input signal;

a port for delivering a radio frequency output signal;

a first elongated conductor, suspended in air between two ground planes, for connecting the input with the port; the first conductor comprising a sandwich structure with a first upper conductive strip, a first intermediate layer comprising a dielectric material and a first lower conductive strip;

a second elongated conductor, suspended in air between two ground planes, the second elongated conductor comprising a sandwich structure with a second upper conductive strip, a second intermediate layer comprising a dielectric material and a second lower conductive strip;

said first elongated conductor and said second elongated conductor being substantially parallel;

said first upper and lower conductive strips and said second upper and lower conductive strips, respectively, having conductive interconnections; wherein said port for delivering a radio frequency output signal is also arranged to deliver electric power supply to active circuitry connected to said port.

This solution advantageously eliminates the need for a separate conductor in order to deliver electric power supply to active circuitry connected to the port. Such active circuitry may be positioned at some distance from the directional coupler, and therefore the elimination of a conductor leads to simplified installation of a radio base station, as well as reduced costs. The solution enables the delivery of the radio frequency output signal and the electric power supply on the same conductor. Therefore the costs are reduced both on account of lower materials costs—one conductor eliminated- and lower labour costs, since fewer conductors need to be installed.

Another aspect of the invention relates to a directional coupler for radio frequency application, comprising:

an input for receiving a radio frequency input signal;

a port for delivering a radio frequency output signal;

a first elongated conductor, suspended in air between two ground planes, for connecting the input with the port; the first conductor comprising a sandwich structure with a first upper conductive strip, a first intermediate layer comprising a dielectric material and a first lower conductive strip;

a second elongated conductor, suspended in air between two ground planes, the second elongated conductor comprising a sandwich structure with a second upper conductive strip, a second intermediate layer comprising a dielectric material and a second lower conductive strip;

said first elongated conductor and said second elongated conductor being substantially parallel;

said first upper and lower conductive strips and said second upper and lower conductive strips, respectively, having conductive interconnections. The conductive interconnections substantially eliminates any electrical field in the dielectric material between them.

According to an embodiment of the invention the directional coupler is modified in that air is replaced by inert material or vacuum.

According to an embodiment of the directional coupler the first elongated conductor comprises at least one further electrically conductive strip embedded in said first intermediate dielectric layer. The at least one further electrically conductive strip is electrically connected to said first upper and lower conductive strips by means of said conductive interconnections. The provision of this intermediate electrically conductive strip advantageously improves the performance of the directional coupler.

According to an embodiment of the directional coupler said port for delivering a radio frequency output signal is connected to a lightning protection device. The provision of a lightning protection device advantageously protects any circuitry coupled to the directional coupler from the electric pulse caused by flashes of lightning hitting the radio base station antenna.

A further elongated conductor is connected to the said first elongated conductor, said further elongated conductor being designed such as to cause full reflection of any radio frequency transmission signal $T_x$, whereas the electric pulse caused by a flash of lightning is delivered from said first elongated conductor to the lightning protection device. The lightning protection device is advantageously designed so as to lead said electric pulse to ground, thereby protecting the circuitry coupled to the directional coupler from the electric pulse caused by flashes of lightning.

An embodiment of the directional coupler comprises:

said further elongated conductor suspended in air between two ground planes, the further elongated conductor comprising a sandwich structure with a further upper conductive strip, a further intermediate layer comprising a dielectric material and a further lower conductive strip;

said further elongated conductor making electrical contact with said first elongated conductor; wherein said further elongated conductor is provided with a reflecting impedance at a distance from said first elongated conductor. The reflecting impedance provides a matched input for radio frequency signals within a certain bandwidth. The reflecting impedance may comprise a capacitive load at a certain distance, along the conductor, from said first elongated conductor. The reflecting impedance may advantageously be adapted to cause full reflection of a radio frequency transmission signal $T_x$.

The dielectric substrate may be provided with cut out portions in the region adjacent to the sides of said further elongated conductor. Therefore the electric fields in that region will propagate in air (or in another inert material or vacuum), rather than in a dielectric substrate material. The radio frequency losses in the circuitry are dependent on the dissipation factor of the material through which the electric field propagates. Hence, there will be very low losses in said further elongated conductor. This is advantageous since it reduces losses for the signal $T_x$ as it travels to the reflecting impedance and back again.

According to an embodiment said further elongated conductor widens to form a patch just after the reflecting impedance, as seen from said first elongated conductor. According to an embodiment this patch is a multi-layer patch; said multi-layer patch being provided with a plurality of conductive interconnections providing electrical contact between plural conductive layers of said patch. This advantageously minimizes the power generated at said patch in connection with a flash of lightning.

When a flash of lightning hits an antenna connected to the port for delivering a radio frequency output signal, a large current is to be drained from that port to the lightning protection device. The power generated in a conductor depends on the current and the resistance, as defined e.g by Ohms law: $P=U*I=R*I^2$. The further elongated conductor advantageously comprises a plurality of conductive strips, thereby reducing the resistance between the port for delivering a radio frequency output signal and the widened part of the further elongated conductor. Hence the power, and the corresponding heat, generated in the further elongated conductor is minimized.

According to an embodiment said port comprises a patch which is provided with a plurality of conductive interconnections providing electrical contact between plural conductive layers of said patch. This advantageously minimizes the power generated at said port in connection with a flash of lightning.

Advantageously the further elongated conductor comprises more than two conductive layers.

According to an embodiment the directional coupler comprises a strip line for coupling said first elongated conductor to said input for receiving a radio frequency input signal. According to one version of the invention the directional coupler further comprises a high pass filter connected between said strip line and said first elongated conductor. Said high pass filter is adapted to permit the passage of said radio frequency input signal.

An embodiment of the invention relates to an antenna interface unit comprising a first directional coupler, and a second directional coupler; said first and second directional couplers being provided on a common printed circuit board.

According to an embodiment of the antenna interface unit the first directional coupler has a first port for delivering a radio frequency output signal, said first port being arranged to deliver electric power supply to first active circuitry connected to said first port; and the second directional coupler has a second port for delivering a radio frequency output signal, said second port being arranged to deliver electric power supply to second active circuitry connected to said second port.

According to an embodiment of the antenna interface unit said first port and said second port are connected to a common input for receiving a DC power signal. In one version of this antenna interface unit said second port is connected to said common input by mans of a conductor including at least a portion positioned in an intermediate conductive layer. Advantageously this conductor can provide delivery of said DC power signal from said common input to said second port via the intermediate conductive layer which is separate from said strip line for coupling said first elongated conductor to said input for receiving a radio frequency input signal. This solution provides a compact circuit for handling the RF signals, the power supply as well as lightning protection.

An embodiment of the directional coupler further comprises:

a third elongated conductor, suspended in air between said ground planes, the third elongated conductor comprising a sandwich structure with a third upper conductive strip, a third intermediate layer comprising a dielectric material and a third lower conductive strip;

said first elongated conductor and said third elongated conductor being substantially parallel;

said third upper and lower conductive strips having conductive interconnections for substantially eliminating any electrical field in the dielectric material between them; wherein said third conductor is shaped and positioned such as to provide a coupled output indicative of a power of a radio frequency signal propagating in a direction from said a port towards said input. According to an embodiment said a third elongated conductor is separate from said second elongated conductor.

According to an embodiment of the directional coupler said second elongated conductor is provided along one side of said first elongated conductor; and said third elongated conductor is provided along another side of said first elongated conductor.

Further variations and embodiments of the invention are provided in the enclosed specification and claims.

BRIEF DESCRIPTION OF THE DRAWINGS

For simple understanding of the present invention, it will be described by means of the examples and with reference to the accompanying drawings, of which.

DETAILED DESCRIPTION OF EMBODIMENTS

Figure 1:
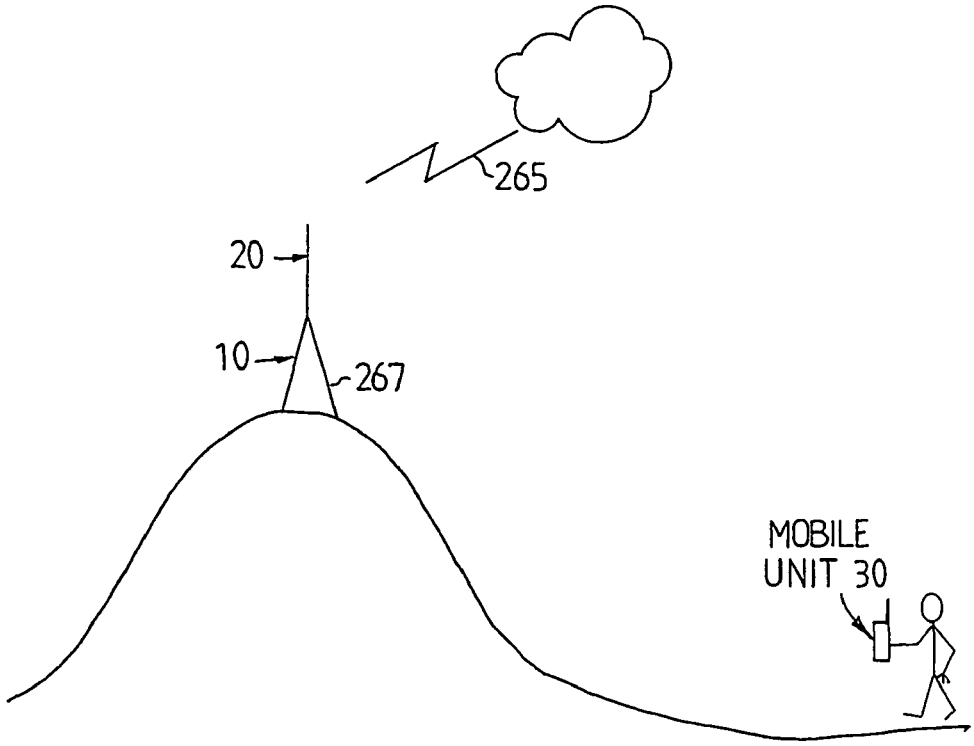
FIG. 1 illustrates a radio base station having an antenna placed on high ground for providing good radio coverage to mobile units in the geographic neighbourhood.

In the following description similar features in different embodiments will be indicated by the same reference numerals.

FIG. 1 shows a radio base station 10 having an antenna 20 placed on a hill for providing good radio coverage to mobile units 30 in the geographic neighbourhood.

Figure 2:
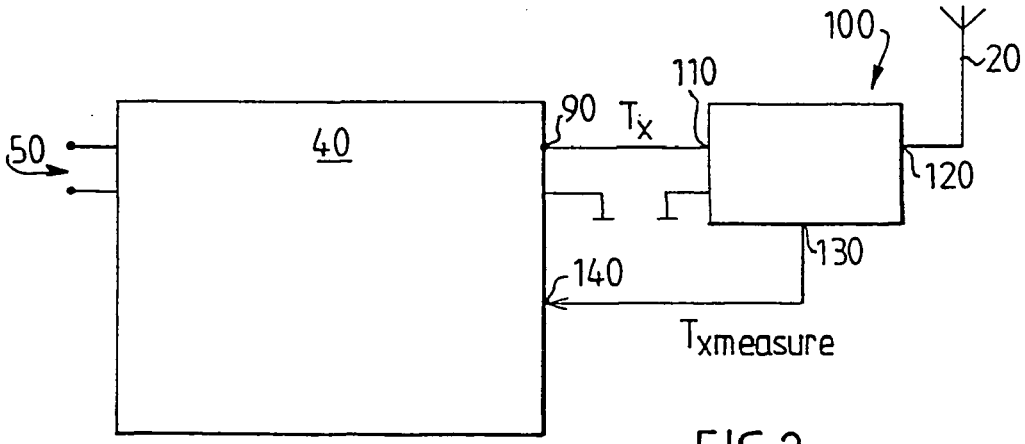
FIG. 2 is a schematic block diagram illustrating a transceiver/receiver unit having an input for receiving a message to be transmitted.

FIG. 2 is a schematic block diagram illustrating a transceiver/receiver unit 40 having an input 50 for receiving a message to be transmitted. The transceiver unit 40 has an output 90 for providing a radio frequency transmission signal, modulated with the message, to the antenna 20. The output 90 of the transceiver unit 40 is connected to the antenna 20 via an antenna interface unit 100. Hence, the antenna interface unit 100 has an input 110 coupled to the output 90 of the transceiver unit 40, and a port 120 for providing the radio frequency transmission signal to the antenna 20. The antenna interface unit 100 includes a directional coupler 122 having an output 130 for a feedback signal. The output 130 is coupled to a feedback input 140 of the transceiver unit 40.

The feedback signal $T_{xmeasure}$ received on the output 130 is indicative of the power of the transmission signal delivered from the port 120 of the antenna interface unit. Hence, the feedback signal $T_{xmeasure}$ can be used in the transceiver unit 40 for controlling the transmission power of the radio base station 10 so as to provide radio coverage to mobile units 30 in an area of a desired size in the geographic neighbourhood.

The radio frequency transmission signal may have any frequency suitable for radio communication. According to some embodiments of the invention the radio frequency transmission signal may have a frequency of 350 Mhz or higher.

According to preferred embodiments of the invention the frequency may be higher than 800 MHz.

Figure 3:
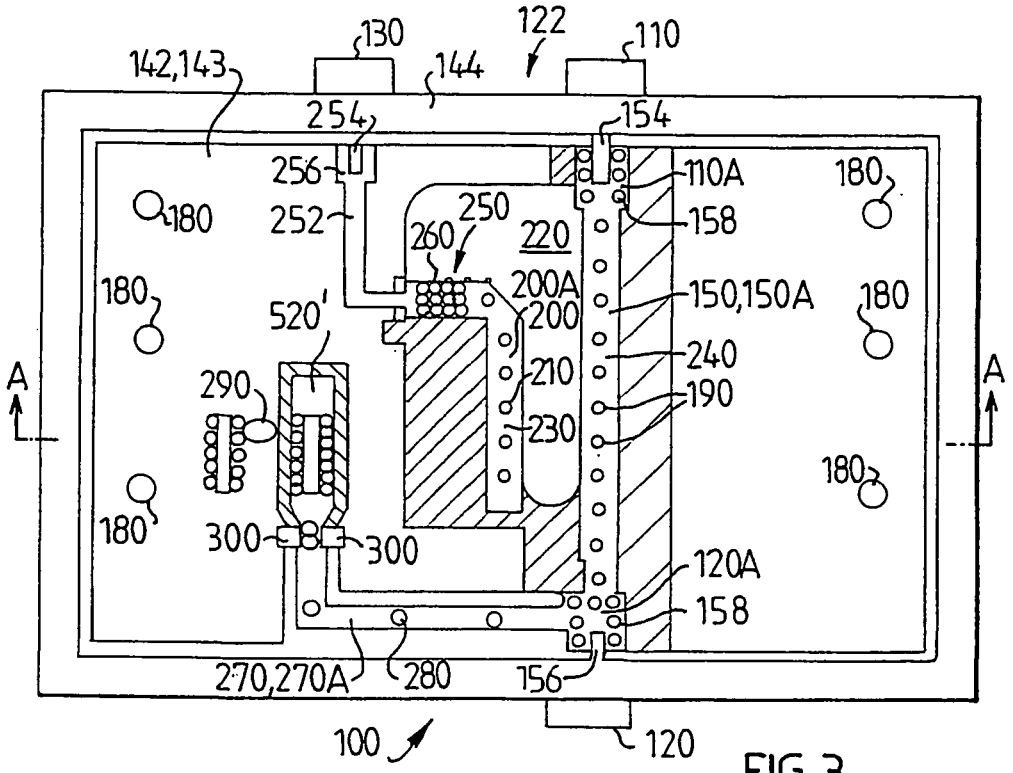
FIG. 3 is top plan view of an embodiment of the antenna interface unit including an embodiment of the directional coupler.

FIG. 3 is top plan view of an embodiment of the antenna interface unit 100 including an embodiment of the directional coupler 122. The directional coupler 122 includes a substrate 142 mounted in a casing 144. The substrate 142 is provided with an elongated electrically conductive strip 150A, connecting an input patch 110A to a port patch 120A. The substrate in combination with the conductors and other components forms a printed circuit board (pcb)143. The input 110 may include a coaxial contact having a centre conductor 154 for contacting input patch 110A at the end of the conductor 150, as illustrated in FIG. 3. Similarly, port 120 may include a coaxial contact having a centre conductor 156 for contacting input patch 120A at the opposite end of the conductive strip 150A. Input patch 110A and port patch 120A are densely provided with plated through openings 158 providing good electrical contact between the conductive layers at the two opposite ends of the conductor 150.

Figure 4:
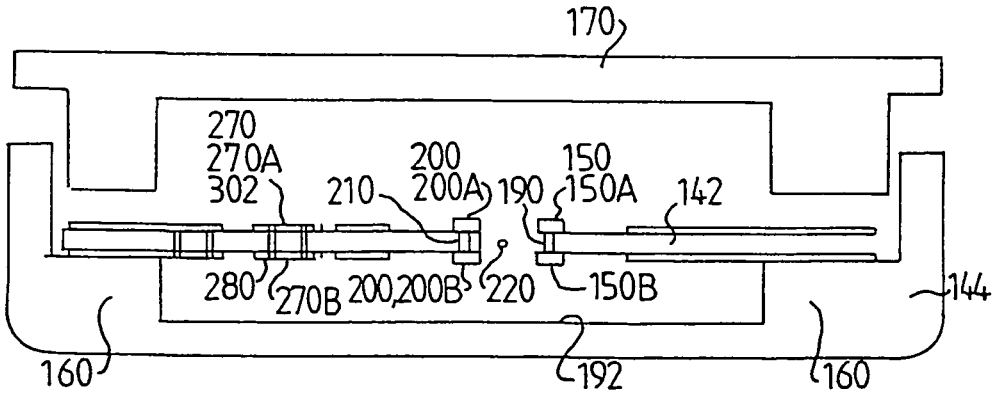
FIG. 4 is a cross-sectional view taken along line A—A of FIG. 3.

FIG. 4 is a cross-sectional view taken along line A—A of FIG. 3. As shown in FIG. 4, the pcb 143 rests on shoulders 160 in the casing 144. The pcb 143 may be firmly attached to the casing by means of screws (not shown) introduced through suitable openings in the casing lid 170 (FIG. 5) and through openings 180 (FIG. 3) in the pcb 143 and casing 144.

The casing 144, and lid 170 can be made of an electrically conductive material, such as an aluminium alloy. When the lid 170 is attached to the bottom part 144 of the casing the pcb 143 will be confined in a closed chamber. The conductive walls of the chamber are connected to ground so as to provide ground planes in relation to conductors on the substrate 142. The chamber may be filled with air, or another inert material. The inert material may be an inert gas. Alternatively, there may be a vacuum, instead of inert material, in the chamber.

The conductive strip 150A is electrically connected to another conductive strip 150B on the opposite side of the dielectric substrate 142 by means of plated through openings 190 (FIGS. 3 and 4). Hence, the conductive strips 150A and 150B form an elongated conductor 150 connecting the input 110 with the port 120. Since the strips 150A and 150B are interconnected they will have the same electrical potential, and hence there will be substantially no electrical field in the dielectric substrate between the strips 150A and 150B. Instead, when a radio frequency transmission signal $T_x$ is supplied to the input 110, there will be an electric field extending between the conductive strip 150A and the ground plane formed by lid 170. Additionally an electric field will extend between the conductive strip 150B and the ground plane formed by inner wall 192 of casing 144 (FIG. 4).

The antenna interface unit 100 also includes a second elongated conductor 200, having conductive strips 200A and 200B on opposite sides of the substrate 142, as illustrated in FIGS. 4 and 3. The elongated conductive strips 200A and 200B are interconnected by plated through openings 210 (FIGS. 3 and 4). The interconnection of the strips 200A and 200B provides for a common electric potential, thereby substantially eliminating any electric fields in the substrate between the strips 200A and 200B, as mentioned above in connection with strips 150A and 150B.

Each one of the conductive strips 150A, 150B, 200A, 200B may comprise a metal layer, such as e.g. copper, aluminium or gold. The conductive plating in the openings 190, 210 is preferably made in the same material as the corresponding metal strip.

The pcb 143 is provided with a cut out portion 220 in the region between the conductor 200 and the conductor 150. Therefore the electric fields in that region will propagate in air (or another inert material or vacuum), rather than in a dielectric substrate material. The losses in the circuitry are dependent on the dissipation factor of the material through which the electric field propagates. In vacuum the dissipation factor equals zero, rendering vacuum a medium without any loss. The dissipation factor of a substrate made by glass fibre reinforced epoxy resin typically has a value in the range from 0,003 to 0,2. Air has a dissipation factor very close to that of vacuum, i.e. very near zero. In this context the term "very near zero" is a value significantly smaller than 0,003.

With reference to FIG. 3, the second conductor 200 has a first conductor portion 230 parallel with a portion 240 of the first conductor 150. The second conductor 200 also has a single second conductor portion 250 extending in a direction perpendicular to the extension of the first conductor portion 230. The second conductor portion 250 includes an output patch 260 connected to the output 130 of the antenna interface unit via a strip line 252. The output 130 may include a coaxial contact having a centre conductor 254 for contacting a pad 256 at the end of the strip line 252, as illustrated in FIG. 3.

In operation, when a transmission signal propagates from the input 110, via the first conductor 150, to the port 120, a certain proportion of the transmission signal will be coupled to the second conductor 200. The coupled signal propagates via the second conductor portion 250 to the output 130 of the antenna interface unit.

The cut out portion 220 extends along the side of the first conductor portion 230 facing towards the first conductor 150. The cut out portion 220 also extends along the side of the second conductor portion 250 such that an electric field in the vicinity of the second conductor 200 on the sides facing the first conductor 150 and the input patch 110A will propagate in air (or in another inert material or vacuum). The fact that the cut-out portion provides a gap along the whole length of the side of conductor 200 advantageously lowers losses.

A problem related to the radio base stations, in particular when placed at a high position in relation to the geographic neighbourhood, is that high objects such as antennae are prone to attract flashes of lightning 265 (FIG. 1) when there are thunderstorms. A large proportion of the energy of such a flash passes through the casing 267 of the radio base station tower (FIG. 1), but a certain amount of energy often travels along the transmission/reception ($T_x$/$R_x$) signal path from the antenna 20 towards the transceiver unit 40 (FIG. 2). This energy may appear as a pulse having a duration of e.g. 350 microseconds and a rise time of some 10 microseconds. The energy pulse from a flash of lightning may generally be in the one megahertz frequency band, which is to be considered a low frequency band in relation to the frequency of the transmission signal $T_x$.

In order to protect sensitive parts in the radio base station, the antenna interface unit 100 is therefore provided with a set of lightning protection devices. According to an embodiment of the invention the antenna interface unit 100 includes a third conductor 270 connected to the port patch 120A (FIG. 3). The third conductor 270 has conductive strips 270A and 270B on opposite sides of the substrate 142, as illustrated in FIGS. 4 and 3. The elongated conductive strips 270A and 270B are interconnected by plated through openings 280 (FIGS. 3 and 4). The interconnection of the strips 270A and 270B provides for a common electric potential, thereby substantially eliminating any electric fields in the substrate between the strips, as mentioned above in connection with strips 150A and 150B.

Figure 5:
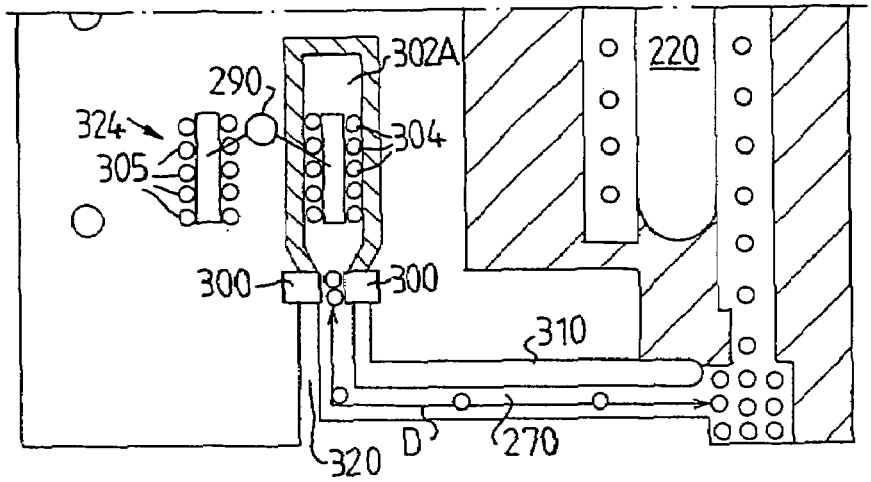
FIG. 5 is an enlarged view of a part of FIG. 3, showing the third conductor.

FIG. 5 is an enlarged view of a part of FIG. 3, showing the third conductor. The third conductor 270 is connected to the port patch 120A and designed such as to cause full reflection of any radio frequency transmission signal $T_x$, whereas the electric pulse from a flash of lightning is forwarded to a lightning protection unit 290. The lightning protection unit 290 is designed so as to lead said electric pulse to ground.

According to an embodiment of the invention, the third conductor 270 is provided with a capacitive load 300 at a distance D, along the conductor, from the port patch 120A (FIG. 3) in order to cause full reflection of any radio frequency transmission signal $T_x$. The capacitive load may comprise two capacitors 300, as illustrated in FIGS. 3 and 5.

The dielectric substrate 142 is provided with cut out portions 310, 320 in the region adjacent to the sides of the conductor 270. Therefore the electric fields in that region will propagate in air (or another inert material or vacuum), rather than in a dielectric substrate material. The radio frequency losses in the circuitry are dependent on the dissipation factor of the material through which the electric field propagates. Hence, there will be very low losses in the conductor 270, which is advantageous since it reduces losses for the signal $T_x$ as it travels between patch 120A and reflecting impedance 300.

Just after the load 300, as seen from the port patch 120A, the conductor 270 widens to form a patch 302.

When a flash of lightning 265 hits the antenna 20 (FIG. 1), a large current is to be drained from port 120 to lightning protection unit 290. The power generated in a conductor depends on the current and the resistance, as defined e.g by Ohms law: $P=U*I=R*I^2$. The conductor 270 advantageously comprises a plurality of conductive strips, as described above, thereby reducing the resistance between port 120 and patch 302. Hence the power, and the corresponding heat, generated in conductor 270 is minimized.

Moreover, the patch 302 is densely provided with plated trough openings 304 providing interconnections between the plurality of conductor layers. A dense provision of plated openings 304 in patch 302 minimize the resistance, thereby enabling the supply of relatively high peak currents from the other conductive layers to the top layer 302A.

According to an embodiment the lightning protection unit 290 comprises a gas-filled surge arrester 290, such as e.g. SIEMENS Type A81-C90XMD. According to an embodiemnt the surge arrester 290, acting as a primary protection unit, cooperates with secondary protection units, such as overvoltage arresters. The lightning protection unit 290 has a first terminal coupled to the patch 302A, and another terminal connected to a ground patch 324. The patch 324 is a portion of a large ground layer, which is densely provided with plated trough openings 305 providing interconnections with other conductive layers having ground potential. The dense provision of plated openings 305 in ground patch 324 minimises the resistance, thereby enabling the supply of relatively high peak currents from the first terminal of the lightning protection unit via the patch 302A to the other conductive layers of ground patch 324.

According to a preferred embodiment the distance D is substantially one quarter of a wavelength of the radio frequency transmission signal. The distance D may also be:

$$D = n * \lambda / 4, \text{ where}$$

$n$ is an odd integer;

$\lambda$ is the wavelength of the radio frequency signal $T_x$

In this connection $\lambda$ is calculated as:

$$\lambda = c / (f * sqrt(\varepsilon_r)), \text{ where}$$

$c$ = the speed of light $f$ = the frequency of the signal $T_x$ $\varepsilon_r$ = the dielectric constant in the medium where the signal propagates.

Since, according to an embodiment of the invention, the dielectric substrate 142 is provided with cut out portions 310, 320 along the sides of the conductor 270 any signal in conductor 270 will propagate through air. Hence, for the purpose of defining the distance D, $\epsilon_r$ will be the dielectric constant for air. Air has a dielectric constant of 1,00059, whereas a substrate made by glass fibre reinforced epoxy resin typically has a dielectric constant value of about 3,3.

Figure 6:
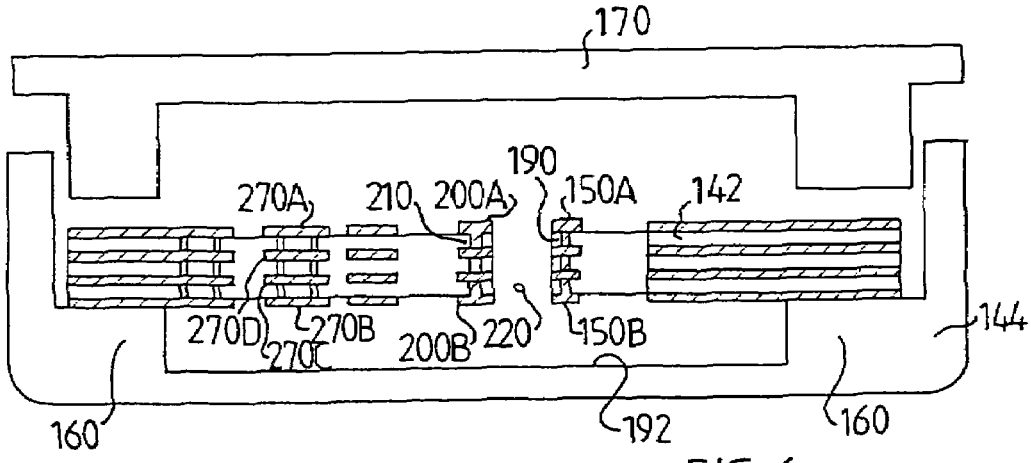
FIG. 6 illustrates a multi-layer embodiment of the antenna interface unit shown in FIGS. 4 and 3.

FIG. 6 illustrates a multi-layer embodiment of the antenna interface unit 100 shown in FIGS. 4 and 3. Hence, FIG. 6 is a cross-sectional view taken along line A—A of a multi-layer embodiment of the antenna interface unit shown in FIG. 3. In addition to conductor layers A and B, there is provided intermediate layers C and D, also interconnected by means of plated through openings.

Figure 7:
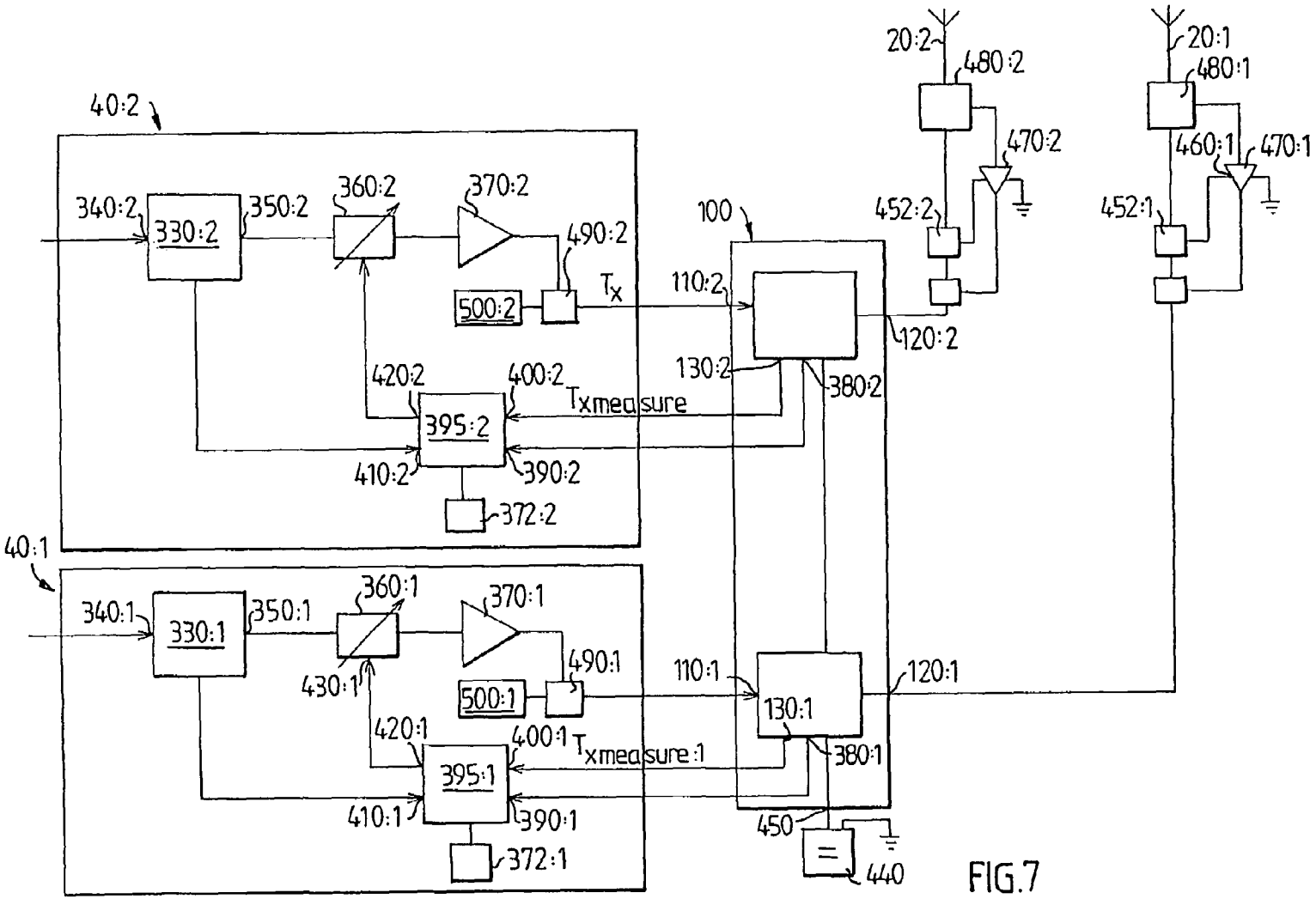
FIG. 7 shows a schematic block diagram of another embodiment of the radio base station parts shown in FIG. 2.

FIG. 7 shows a schematic block diagram of another embodiment of the radio base station parts shown in FIG. 2. A first transceiver unit 40:1 includes a modulator unit 330:1 having an input 340:1 for receiving a message to be transmitted. The modulator unit 330:1 has an output 350:1 for providing a radio frequency transmission signal, modulated with the message, to an adjustable attenuator 360:1, which in turn delivers the attenuated signal to a power amplifier 370:1. The output $T_x$ of the power amplifier 370:1 is delivered to an input 110:1 of an antenna interface unit 100.

The antenna interface unit 100 has a port 120:1 for providing the radio frequency transmission signal to the antenna 20:1. The antenna interface unit 100 includes a directional coupler having an output 130:1 for a feedback signal $T_{xmeasure}$ indicative of the power of the output signal delivered on the port 120:1. The directional coupler also includes another output 380:1 for a signal indicative of a signal $T_{xreflected:1}$ reflected from the antenna 20:1 to the antenna interface unit 100. The power of the signal $T_{xreflected:1}$ is compared to a reference value, and if it deviates from certain limit values the controller 395:1 delivers an alarm signal to an alarm unit 372:1.

The output 380:1 is coupled to a feedback input 390:1 of a control unit 395:1. The output 130:1 is coupled to a feedback input 400:1 of the control unit 395:1. The controller 395:1 receives, on an input 410:1, a signal indicative of the power of the radio frequency signal delivered from the modulator 330:1 to the attenuator 360:1.

A problem in connection with radio base stations is that the total attenuation or amplification of the signal, counted from the output 350:1 to the antenna 20:1, varies in dependence on temperature and other variable factors. I order to compensate for this variation the controller adjusts the total amplification of 360:1, 370:1 by controlling attenuator 360:1 so as to maintain a pre-determined output power level to the antenna 20:1. For this purpose the controller delivers a control signal on an output 420:1 to a control input 430:1 on the attenuator. Hence, the controller adjusts the attenuation in dependence on the signals received on inputs 410:1 and 400:1 such that the power level of the signal $T_{xmeasure:1}$ is kept equal to a reference value. Since $T_{xmeasure:1}$ is indicative of the signal power delivered to the antenna 20:1, this solution will eliminate or significantly reduce the undesired variation of the output signal power.

A second transmitter unit 40:2 functions in the same manner for another message delivered on an input 340:2, in relation to another antenna 20:2.

A DC Power supply unit 440 delivers a power supply voltage to a DC power input 450 of the antenna interface unit 100. The antenna interface unit 100 is advantageously adapted to enable provision of a DC power signal on the ports 120:1, 120:2, i.e. on the same port as the radio frequency transmission signal $T_{x1}$ and $T_{x2}$, respectively. The DC power supply signal delivered on the port 120:1 is separated from the radio frequency transmission signal $T_{x1}$ by a filter 452:1, and the DC power signal is delivered to the power input 460:1 of an amplifier 470:1 (often referred to as tower mounted amplifier, TMA). The filter 452:1 may be embodied by a capacitor, just like capacitor 540:1 in FIG. 8. The amplifier 470:1 operates to amplify the signal $R_x$ received by the antenna 20:1. A filter 480:1 is adapted to deliver the signal $R_x$ received by the antenna 20:1 to the amplifier 470:1, and the amplified $R_x$ signal is delivered to the contact 120:1, via another filter 482:1, so that the received signal $R_x$ can propagate through the antenna interface unit in the direction opposite of the $T_x$ signal. A filter 490:1 in transceiver 40:1 separates the signal $R_x$ and delivers to the circuitry 500:1 designated for demodulation etc.

Figure 8:
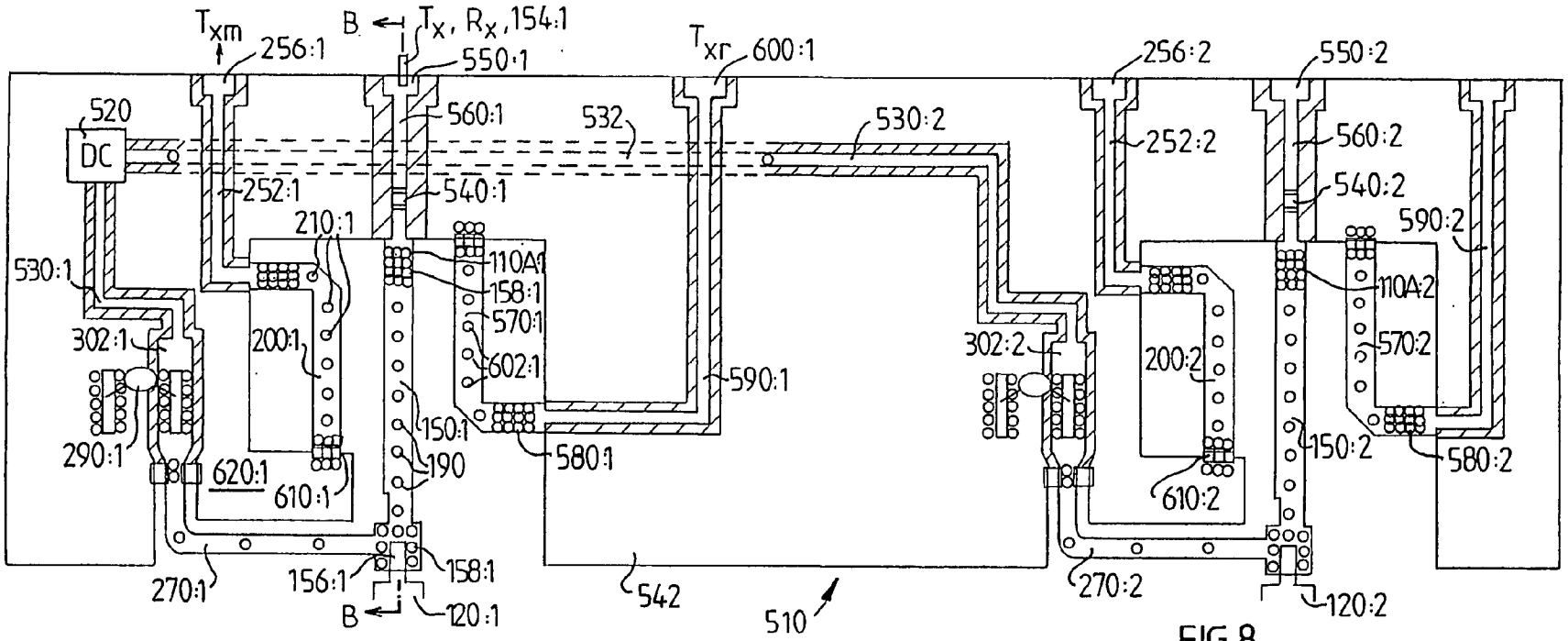
FIG. 8 is a top plan view of a printed circuit board (pcb) in an antenna interface unit according the embodiment described in FIG. 7.

FIG. 8 is a top plan view of a printed circuit board (pcb) 510 in an antenna interface unit 100 according the embodiment described in FIG. 7. The pcb 510 includes a conductive pad 520 connected to the input 450 (FIG. 7) for receiving the DC power signal. A conductor 530:1 (FIG. 8) delivers the DC signal to the patch 302:1, which is connected to the $T_x$ signal output port 120:1 via the flash pulse protection conductor 270:1. Hence, the DC power signal is provided to the DC separation filter 452:1 as described with reference to FIG. 7 above.

Another conductor 530:2 delivers the DC signal from the pad 520 to the patch 302:2, which is connected to the $T_x$ signal output port 120:2. Hence, the DC power signal is provided to the DC separation filter 452:2 as described with reference to FIG. 7 above. As illustrated in FIG. 8 the conductor 530:2 includes a portion 532 where it runs in an intermediate conductive layer, i.e. in a conductive layer between the top conductive layer A and bottom conductive layer B.

In order to prevent the DC power signal from propagating to the first $T_x$ signal input 110:1 (FIG. 7) of the antenna interface unit, there is provided a high pass filter 540:1. The high pass filter 540:1 functions as a DC-blocker and to let the RF signal pass. According to the illustrated embodiment the DC-blocker 540:1 is embodied by a surface mounted capacitor having a capacitance selected so as to permit the passage of the $T_x$ signal and the $R_x$ signal. As illustrated in FIG. 8, the DC blocker 540:1 is provided between the stripline 560:1 and the conductor 150:1. Similarly, there is another DC-blocker 540:2 provided between the stripline 560:2 and the conductor 150:2. Therefore the DC power supply delivered via conductors 532, 530:2 and 270:2 to port 120:2 is prevented from reaching the RF input 550:2.

The $T_x$ signal input 110:1 (FIG. 7) is connected to a pad 550:1 by means of a centre conductor 154:1 (like the centre conductor 154 described in connection with FIG. 3 above). Pad 550:1 connects to a stripline 560:1 adapted to deliver the $T_x$ signal to a patch 110A:1 which is densely provided with plated through openings 158:1 providing good electrical contact between the conductive layers of conductor 150.

Figure 9:
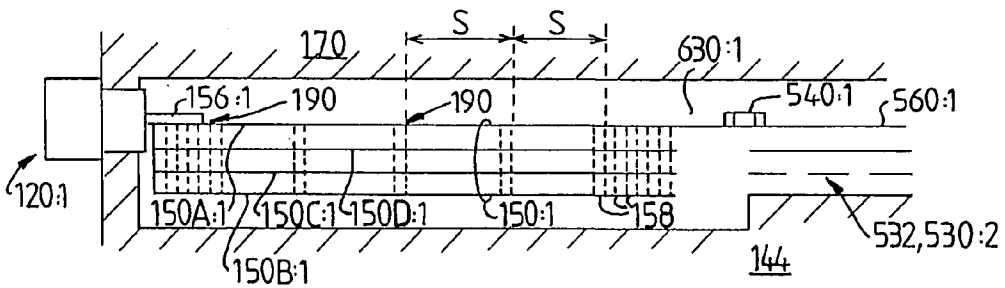
FIG. 9 is a cross-sectional view taken along line B—B of FIG. 8, additionally showing a corresponding cross-section of the casing with lid for the sake of improved clarity.

With reference to FIG. 9 a conductive strip 150A:1 is electrically connected to another conductive strip 150B:1 on the opposite side of the dielectric substrate 542 by means of plated through openings 190. The conductive strips 150A and 150B, sandwiched together with intermediate layers of dielectric material and conductor layers 150C:1 and 150D:1 form an elongated multi-layer conductor 150:1 connecting the input 110:1 with the port 120:1. In the same manner as described with reference to FIG. 3 above there will be substantially no electrical field in the dielectric substrate.

The antenna interface unit 100 also includes a second elongated multi-layer conductor 200:1 (FIG. 8), having conductive strips 200A:1 and 200B:1 (Not shown) on opposite sides of the substrate 542 and intermediate conductive strips 200C:1 and 200D:1 (Not shown). The elongated conductive strips 200A and 200B are interconnected by plated through openings 210:1 (FIG. 8) providing for a common electric potential, thereby substantially eliminating any electric fields in the substrate between the strips 200A and 200B.

Additionally, the antenna interface unit 100 also includes another elongated multilayer conductor 570:1 (FIG. 8), having conductive strips 570A:1 and 57013:1 (Not shown) on opposite sides of the substrate 542 and intermediate conductive strips 570C:1 and 570D:1 (Not shown), interconnected in the same manner as described above. The conductor 570:1 is shaped in a similar way to conductor 200:1, but is positioned such as to provide a coupled output indicative of the power of the $T_x$ signal which is reflected from the antenna 20:1. Conductor 570:1 has patch 580:1 dense with plated through openings connecting to a stripline 590 leading the coupled signal $T_{xreflected}$ to a contact pad 600:1. Contact pad 600:1 connects to a coaxial contact embodying the output 380:1 which is described above in connection with FIG. 7. As mentioned above this signal may be used for error detection purposes, including the generation of an alarm in case of detected abnormal reflected signal values.

The elongated conductive strips 570A:1 and 570B:1 are interconnected by plated through openings 602:1 (FIG. 8) providing for a common electric potential, thereby substantially eliminating any electric fields in the substrate between the strips 570A:1 and 570B:1.

Each one of the conductive strips may comprise a metal layer, such as e.g. copper, aluminium or gold. The conductive plating in the openings is preferably made in the same material as the corresponding metal strip.

The pcb 510 is provided with a cut out portions forming gaps on both sides of conductor 150:1, on both sides of conductor 200:1 and on both sides of conductor 570:1. As illustrated in FIG. 8, the pcb 510 is provided with a cut out portions forming gaps on both sides of conductor 270:1 as well. In FIG. 8 the cut out portions-or gaps-of the pcb 510 are indicated by dotted areas. Shaded areas in FIG. 8 indicate bare dielectric material providing isolation from other neighbouring conductors or ground planes.

Therefore the electric fields in that region will propagate in air (or another inert material or vacuum), rather than in a dielectric substrate material. The radio frequency losses in the circuitry are dependent on the dissipation factor of the material through which the electric field propagates. In vacuum or free space the dissipation factor equals zero, rendering free space a medium without any loss. The dissipation factor of a substrate made by glass fibre reinforced epoxy resin typically has a value in the range from 0,003 to 0,2. Air has a dissipation factor very close to that of vacuum, i.e. very near zero. In this context the term "very near zero" is a value significantly smaller than 0,003.

The bandwidth of the conductor 270:1 depends on the width of the conductive strips, the distance D (described in connection with FIG. 5 above) and the capacitance in the capacitive load 300. By decreasing the width of the conductor 270:1, the bandwidth will be increased. The provision of cut out portions forming gaps on both sides of conductor 270:1 renders a higher impedance in conductor 270:1 than the case would be with solid dielectric material near the sides of conductor 270:1. This has to do with the value of the relevant dielectric constant. Advantageously, the provision of cut out portions forming gaps on both sides of conductor 270:1 also improves the bandwidth of conductor 270:1. Tests indicate that the radio frequency bandwidth of conductor 270, 270:1 increases more than 15 percent when dielectric material near the sides of conductor 270:1 is removed so as to be replaced by cut out portions forming gaps.

Improved Directivity

With reference to FIG. 8 the directive coupler formed by conductors 150:1, 200:1 and 570:1 provides an advantageously good directivity, thereby providing for accurate signal measurements. With regard to the primary conductor 150:1 along which radio signal $T_x$ travels from pad 550:1 to port 120:1, the conductor 200:1 is a secondary conductor. Due to the geometry and the fact that conductor 200:1 is parallel to primary conductor 150:1 the degree of coupling between the conductors is predictable. The fact that the pcb can be produced in a rational manner, by etching pressing, drilling the cut outs, and plating/etching before finally milling, provides a stable production method rendering a low cost antenna interface unit. The fact that the flash protection circuitry is integrated on the pcb additionally reduces the number of separate circuits and casings needed, thereby further improving the cost benefit of the present solution.

The coupling between conductors 150:1 and 200:1 is such that the signal $T_x$ travelling from pad 550:1 to port 120:1 is coupled so as to produce a measured signal $T_{xmeasure}$ at the upper end of the conductor 200:1 as seen in FIG. 8. Similarly a certain proportion of a reflected signal $T_{xreflected}$, travelling along conductor 150:1 in the direction from port 120:1 to pad 550:1 generates a signal in the lower end of conductor 200:1 as seen in FIG. 8. In order to eliminate any interference in the measurements from this undesired signal, there is provided a balanced termination impedance 610:1. The termination impedance 610:1 is connected from the end of conductor 200:1 to ground. Ground is provided as a large conductive layer in the top or A-layer of the pcb 510.

The value of the impedance 610:1 is preferably selected to a value identical to the impedance seen when looking into the coupler from the end of conductor 200, i.e. when looking from the position of impedance 610:1. In a preferred embodiment the value of the impedance 610:1 will be 50 ohm. Due to the advantageous fact that the conductors are surrounded only by air such that all coupled electric energy has passed through the same medium- air- the coupled signal will be of substantially one single phase. This in turn provides for a resulting high degree of directivity.

The air, mentioned above, may be replaced by another inert material or vacuum while maintaining the advantageous properties.

FIG. 9 is a cross-sectional view taken along line B—B of FIG. 8, additionally showing a corresponding cross-section of the casing 144 with lid 170 for the sake of improved clarity.

As illustrated on the left hand side in FIG. 9 conductor 150:1 includes four conductive layers, sandwiched by dielectric layers and interconnected by plated openings 190. At the portion with an extra high concentration of plated openings 158:1 the four layer conductor is transformed to a strip line 630:1 leading to DC stop capacitor 540:1. The surface conductive layer is interrupted under the surface mounted capacitor 540:1 so as to hinder DC current from flowing to strip line 560:1.

The invention claimed is:

1. A directional coupler for radio frequency application, comprising:

an input for receiving a radio frequency input signal;

a port for delivering a radio frequency output signal;

a first elongated conductor, suspended in air between two ground planes, for connecting the input with the port; the first elongated conductor comprising a sandwich structure with a first upper conductive strip, a first intermediate layer comprising a dielectric material and a first lower conductive strip;

a second elongated conductor, suspended in air between two ground planes, the second elongated conductor comprising a sandwich structure with a second upper conductive strip, a second intermediate layer comprising a dielectric material and a second lower conductive strip;

said first elongated conductor and said second elongated conductor being substantially parallel;

said first upper and lower conductive strips and said second upper and lower conductive strips, respectively, having conductive interconnection;

a power supply input for receiving electric power;

wherein said port for delivering said radio frequency output signal is connected to said power supply input and arranged to deliver electric power supply to active circuitry connected to said port, whereby said radio frequency output signal and said electric supply power are provided on the same conductors;

wherein said port for delivering a radio frequency output signal is connected to a lightning protection device.

2. A directional coupler for radio frequency application, comprising:

an input for receiving a radio frequency input signal;

a port for delivering a radio frequency output signal;

a first elongated conductor, suspended in air between two ground planes, for connecting the input with the port; the first elongated conductor comprising a sandwich structure with a first upper conductive strip, a first intermediate layer comprising a dielectric material and a first lower conductive strip;

a second elongated conductor, suspended in air between two ground planes, the second elongated conductor comprising a sandwich structure with a second upper conductive strip, a second intermediate layer comprising a dielectric material and a second lower conductive strip;

said first elongated conductor and said second elongated conductor being substantially parallel;

said first upper and lower conductive strips and said second upper and lower conductive strips, respectively, having conductive interconnections;

a power supply input for receiving electric power;

wherein said port for delivering said radio frequency output signal is connected to said power supply input and arranged to deliver electric power supply to active circuitry connected to said port, whereby said radio frequency output signal and said electric supply power are provided on the same conductors;

a further elongated conductor suspended in air between two ground planes, the further elongated conductor comprising a sandwich structure with a further upper conductive strip, a further intermediate layer comprising a dielectric material and a further lower conductive strip;

said further elongated conductor making electrical contact with said first elongated conductor; and, wherein said further elongated conductor is provided with a capacitive load at a distance (D), providing a matched input for radio frequency signals within a certain bandwidth.

3. The directional coupler according to claim 2, wherein said a first elongated conductor comprising at least one further electrically conductive strip embedded in said first intermediate dielectric layer, said at least one further electrically conductive strip being electrically connected to said first upper and lower conductive strips by means of said conductive interconnections.

4. The directional coupler according to claim 2, wherein said conductive interconnections are mutually spaced along in the direction of elongation of the respective conductor: said spacing being less than a quarter of a wavelength of said radio frequency signal.

5. The directional coupler according to claim 4, wherein said conductive interconnections are mutually spaced along in the direction of elongation of the respective conductor; said spacing being less than ⅛ of a wavelength of said radio frequency signal.

6. The directional coupler according to claim 2, wherein said port for delivering a radio frequency output signal also is arranged to deliver electric power supply to active circuitry connected to said port.

7. The directional coupler according to claim 2, wherein said port for delivering a radio frequency output signal is connected to a lightning protection device.

8. The directional coupler according to claim 2 modified in that air is replaced by inert material or vacuum.

9. The directional coupler according to claim 2, further comprising:

a third elongated conductor, suspended in air between said ground planes, the third elongated conductor comprising a sandwich structure with a third upper conductive strip, a third intermediate layer comprising a dielectric material and a third lower conductive strip;

said first elongated conductor and said third elongated conductor being substantially parallel;

said third upper and lower conductive strips having conductive interconnections for substantially eliminating any electrical field in the dielectric material between them; wherein said third conductor is shaped and positioned such as to provide a coupled output ($T_{xR}$) indicative of a power of a radio frequency signal propagating in a direction from said a port towards said input.

10. The directional coupler according to claim 9, wherein said a third elongated conductor is separate from said second elongated conductor.

11. The directional coupler according to claim 9, wherein said second elongated conductor is provided along one side of said first elongated conductor; and said third elongated conductor is provided along another side of said first elongated conductor.

12. The directional coupler according to claim 2, wherein said port comprises a patch which is provided with a plurality of conductive interconnections providing electrical contact between plural conductive layers of said patch.

13. The directional coupler according to claim 7, wherein said lightning protection device has a first terminal connected to a multi-layer patch; said multi-layered patch being connected to said port patch via an elongated conductor;

said multi-layer patch being provided with a plurality of conductive interconnections providing electrical contact between plural conductive layers of said patch.

14. The directional coupler according to claim 9, wherein said dielectric material has a fourth opening defining a gap between said first elongated conductor and said third elongated conductor; and at least one of:

a fifth opening defining a gap along a side of said third elongated conductor facing away from said first elongated conductor; and/or a sixth opening defining a gap along a side of said first elongated conductor facing away from said third elongated conductor.

15. The directional coupler according to claim 13, wherein said elongated conductor comprises more than two conductive layers.

16. The directional coupler according to claim 2, wherein a strip line couples said first elongated conductor to said input for receiving a radio frequency input signal.

17. The directional coupler according to claim 16, further comprising a high pass filter connected between said strip line and said first elongated conductor.

18. The directional coupler according to claim 17, wherein said high pass filter is adapted to permit the passage of said radio frequency input signal.

19. The directional coupler according to claim 2, wherein said radio frequency input signal has a frequency of 350 Mhz or higher.

20. The directional coupler according to claim 2, wherein said dielectric material has a first opening defining a gap between said first elongated conductor and said second elongated conductor; and at least one of:

a second opening defining a gap along a side of said second elongated conductor facing away from said first elongated conductor; and/or a third opening defining a gap along a side of said first elongated conductor facing away from said second elongated conductor.

21. A directional coupler for radio frequency application, comprising:

an input for receiving a radio frequency input signal;

a port for delivering a radio frequency output signal;

a first elongated conductor, suspended in air between two ground planes, for connecting the input with the port; the first elongated conductor comprising a sandwich structure with a first upper conductive strip, a first intermediate layer comprising a dielectric material and a first lower conductive strip;

a second elongated conductor, suspended in air between two ground planes, the second elongated conductor comprising a sandwich structure with a second upper conductive strip, a second intermediate layer comprising a dielectric material and a second lower conductive strip;

said first elongated conductor and said second elongated conductor being substantially parallel;

said first upper and lower conductive strips and said second upper and lower conductive strips, respectively, having conductive interconnections;

a power supply input for receiving electric power;

wherein said port for delivering said radio frequency output signal is connected to said power supply input and arranged to deliver electric power supply to active circuitry connected to said port, whereby said radio frequency output signal and said electric supply power are provided on the same conductors;

wherein said electric power comprises DC power, and wherein a high pass filter is provided between the first elongated conductor and the radio frequency input so as to prevent said electric power from reaching said radio frequency input.

* * * * *